US006123008A

United States Patent [19]

Scherer

[11] Patent Number: 6,123,008

[45] Date of Patent: Sep. 26, 2000

[54] COMPRESSED-AIR PISTON ENGINE

[75] Inventor: Oswald Scherer, Lahnau, Germany

[73] Assignee: Wiwa Wilhelm Wagner GmbH & Co. Kg, Lahnau, Germany

[21] Appl. No.: 09/098,824

[22] Filed: Jun. 17, 1998

[30] Foreign Application Priority Data

Jun. 19, 1997 [DE] Germany ..... 297 10 807

[51] Int. Cl.[7] ..... F01L 25/02

[52] U.S. Cl. ..... 91/306; 91/313

[58] Field of Search ..... 91/304, 305, 306, 91/308, 310, 311, 313, 461

[56] References Cited

U.S. PATENT DOCUMENTS

| | | | |
|---|---|---|---|
| 630,380 | 8/1899 | Mann | 91/306 X |
| 811,665 | 2/1906 | Sage | 91/306 |
| 833,809 | 10/1906 | Turner | 91/306 |
| 1,089,718 | 3/1914 | Metzelaar | 91/306 X |
| 1,161,787 | 11/1915 | Nickol | 91/306 X |
| 2,759,455 | 8/1956 | Kind | 91/461 X |
| 3,348,803 | 10/1967 | Churchill, Jr. | 91/313 X |
| 3,374,713 | 3/1968 | Broughton | 91/313 X |
| 3,618,468 | 11/1971 | Gardner et al. | 91/306 X |
| 4,104,008 | 8/1978 | Hoffmann et al. | 91/306 X |
| 4,381,180 | 4/1983 | Sell | 91/306 X |
| 4,846,045 | 7/1989 | Grach et al. | 91/306 |
| 5,377,719 | 1/1995 | Gyllinder et al. | 91/313 X |

FOREIGN PATENT DOCUMENTS

| | | | |
|---|---|---|---|
| 299211 | 6/1917 | Germany | 91/313 |
| 330 195 | 9/1917 | Germany . | |
| 330195 | 12/1920 | Germany | 91/313 |
| 643575 | 4/1937 | Germany | 91/306 |
| 720237 | 4/1942 | Germany | 91/313 |
| 1 301 632 | 8/1969 | Germany . | |
| 33 42 388 C3 | 6/1985 | Germany . | |
| 480981 | 5/1953 | Italy | 91/306 |

*Primary Examiner*—John E. Ryznic

*Attorney, Agent, or Firm*—Flynn, Thiel, boutell & Tanis, P.C.

[57] ABSTRACT

A compact transportable compressed-air piston engine for paint-spraying devices, dosing pumps, grease guns or the like, makes it possible, without much effort, to carry out various length working strokes of a working piston. A compact engine is obtained by mounting the control in/on the cylinder head or in/on the cylinder bottom with axes extending transversely with respect to a main axis so that stroke changes can be achieved solely by the working piston contacting the valve piston rods of switch valves. In addition, return springs are not needed in the switch valves, which are required for reversing and are operated by the working piston.

18 Claims, 4 Drawing Sheets

COMPRESSED-AIR PISTON ENGINE

FIELD OF THE INVENTION

The invention relates to a compressed-air piston engine, in particular for paint-spraying devices, dosing pumps, grease guns and the like, including a working piston with a piston rod, which working piston can be moved by alternately loading the surfaces of the piston, and thus it oscillates in a piston cylinder driven by compressed air on its two piston surfaces by means of a slide control, which piston rod is axially guided in a cylinder head and/or a cylinder bottom, in each an inlet/outlet is provided for the compressed-air supply or discharge into/out of the piston cylinder, whereby the slide control has a control piston movable in a control cylinder, and control openings are provided in the control cylinder, which control openings fluidly connect a supply/discharge pipeline or vent pipelines for the compressed air to the control cylinder, and are controlled by the control piston. Furthermore, the invention relates to a compressed-air piston engine with a switch valve for the compressed air in the cylinder head and the cylinder bottom, which can be operated by the working piston and switches the slide control, whereby the switch valves have a valve piston rod projecting into the piston cylinder and operable by the working piston of the compressed-air piston engine.

BACKGROUND OF THE INVENTION

A single acting compressed-air piston engine is already known and can also be designed to be double acting without much effort, wherein a working device is connected to each face of the compressed-air piston engine. The piston cylinder can thereby be constructed in one piece with the cylinder head or the cylinder bottom, however, it is advantageous when both the cylinder head and also the cylinder bottom are manufactured separately from the piston cylinder, and the parts are subsequently assembled, as this is, for example, done in Patent DE 33 42 388 C3 so that the necessary machining on the parts can be kept to a minimum.

The slide controls, which are needed for switching the linear movement of the working piston and are provided outside of the piston cylinder, are independent of this in such compressed-air piston engines and are placed so that the axes of the associated control piston of the control cylinder extend parallel to the axis of the working piston.

The slide control is either laterally attached to the piston cylinder and, if necessary, designed in one piece with same, or it is provided just like in the arrangement corresponding to DE 33 42 388 C3 above the cylinder head, or, if necessary, also below the cylinder bottom; the slide control can be structurally integrated into these structural parts. Both arrangements are unfavorable.

In the first case, it is not possible to change the working stroke of the working piston without having to exchange at the same time the entire slide control, which in each case is designed only for a specific working stroke and thus for a specific height of the piston cylinder. Since very different working strokes are needed for the various uses, the manufacturer of such a compressed-air piston engine must have many differently dimensioned slide controls in storage; an adapting of the working stroke by the user is not possible or only possible with great difficulties.

In the second case, the structural length of the compressed-air piston engine is significantly increased solely by the slide control because even if the control piston can be kept shorter than the working piston, it does require significant additional space in the axis extending direction of both pistons at the same time, which space is added to the required space for the working piston.

It is also already known to initiate the switching of the working piston through the initially-mentioned switch valves, in each case the valve piston rod moves a valve piston against the force of a return spring when it is carried along by the working piston in its working direction on the last portion of its working stroke; after the working stroke has been switched the return spring moves the valve piston including the valve piston rod again into its initial position.

The purpose of the invention is to overcome the above-described disadvantages of the known compressed-air piston engines of the type identified in detail above and to mount a slide control space-savingly and fittingly with respect to various working strokes of the working piston. Moreover, a further purpose of the invention is to design the needed mountings in such a compressed-air piston engine simply and to limit same to few structural parts.

SUMMARY OF THE INVENTION

The purpose is attained according to the invention, first, in such a manner that the slide control is provided in/on the cylinder head or in/on the cylinder bottom, in such a manner that the axes of the control piston and of the working piston are positioned approximately vertically above one another.

It is entirely sufficient for the slide control to extend in the direction of its axis only so far that it does not, or does not significantly, exceed the outer circumference of the cylinder head or bottom, the slide control axis extending transversely with respect to the piston cylinder, so that through the slide control merely the structural height of the cylinder head or bottom increases slightly. However, the increase of this structural height due to inclusion of the integrated slide control can now be limited to a minimum dimension since the extent of such a slide control extending transverse with respect to its axis can be kept small compared with its extent in the axial direction.

The change of the working stroke of a compressed-air piston engine designed in this manner results—essentially—merely in a corresponding change of the piston cylinder, which can be easily exchanged. It is remarkable that this advantage does not require any additional compressed-air guides, since in comparison with the conventional arrangements, fewer rather than more structural parts must be used, and, in particular, the significant ones, namely cylinder head and bottom, are designed independently of the structural length of the piston cylinder.

It is thereby particularly advantageous when the axis of the control piston is spaced from the axis of the working piston because the piston rod can then be supported at both ends and/or can be guided both through the cylinder head or also through the cylinder bottom without being thereby hindered by the slide control.

A preferred embodiment of such a compressed-air piston engine of the invention using a switch valve in the cylinder head and the cylinder bottom, which switch valve can be operated by the working piston, consists of each of the switch valves being provided with a differential slide, which consists of a first valve piston of a larger piston surface and a second valve piston of a smaller piston surface, which are fastened at a fixed distance in alignment on the valve piston rod in such a manner that the air pressure from a branch pipeline standing in the valve housing moves the differential slide into a first end position, in which its valve piston rod projects partially into the piston cylinder. The differential slide is in connection with the constantly standing air pressure in the preferred first end position, from which it can be moved solely under the action of the working piston on its valve piston rod into a second end position—against the force from the air pressure, which force acts on the differential slide piston. A return spring is in this manner not needed, when merely care is taken that the piston surfaces of the differential piston are continuously exposed to the compressed air.

In detail, it is particularly advantageous when the switch valve is axis-parallel with respect to the working piston, and a circular-cylindrical passage for supporting the differential slide is provided in the cylinder head/bottom, whereby the passage is blocked off against the piston cylinder best by means of a preferably elastic closure, through which penetrates the valve piston rod, and against which the first valve piston can be placed under the action of the compressed air, thus the first valve piston slightly resiliently abuts against the elastic closure so that noise and wear are kept low. On the other side, on its side opposite this air blocking, the passage has advantageously a threaded bushing set by means of a locking screw, in which threaded bushing the second valve piston is guided, which blocks a supply/discharge pipeline leading into the switch valve as long as the first valve piston rests on the closure. With this it is assured that the differential slide is in the first end position, independent of the air pressure standing in the supply/discharge pipeline, as long as it is not moved out of same by the working piston.

Such an operation of the switch valves in connection with the working piston is guaranteed when at least one control opening for the supply/discharge pipelines from the switch valves, a main pipeline from the compressed-air source, and a vent pipeline from the compressed-air piston engine into the environment are provided in the control cylinder; furthermore, when in/outlets, which are connected to the slide control through working pipelines, for the compressed air in the piston cylinder are controlled on both sides of the working piston each by one of the switch valves, which is connected through a branch pipeline through the main pipeline to the compressed-air source and influences one of the supply/discharge pipelines to and from the control cylinder; still furthermore, when the control piston can be moved axially oscillatingly by the compressed air alternately flowing through these supply discharge pipelines; finally, when control chambers are provided on the control piston, which control chambers influence the control openings so that the main pipeline is connected alternately to an inlet/outlet, and at the same time an outlet to the environment; and finally, when branch pipelines from the main pipeline are branched off and are unblocked. The control chambers are advantageously constructed such that the compressed-air source is fluidly connected through the main pipeline at all times to one of the in/outlets.

Compressed-air connections between the cylinder head and cylinder bottom can be accomplished in a simple manner by fixed pipe sections clamped between both, which in a suitable manner connect their compressed-air guides; they must be exchanged together with the piston cylinder when the working stroke is changed. It is thereby, for example, advantageous when one of the branch pipelines, one of the working pipelines for the in/outlets, and/or the supply/discharge pipeline of one of the switch valves are guided with the slide control through a pipe section clamped between the cylinder head and the cylinder bottom outside of the piston cylinder.

In detail, it is furthermore advantageous when the control cylinder is closed on the front end face by locking parts so that it can be designed as a bore passing through the cylinder head/bottom; screw caps are best used for the locking parts. When elastic stops are preferably provided on the front end face on the control piston, which stops alternately strike the locking parts, then the control piston itself is protected; the elastic design of the stops extends the lifetime of the control piston and reduced noise generation.

The supply/discharge pipelines from the switch valves end in the vicinity of the locking parts so that they cannot be influenced by the control piston, and same is subjected to the air pressure of the compressed-air source alternately on its two end faces.

A structurally particularly simply design of the control piston occurs when on same a second control chamber is provided on both sides of the first control chamber, and is fluidly connected alternately with one associated outlet.

All in all, a remarkable improvement of its service-free lifetime has been achieved beyond the structural simplification of the compressed-air piston motor and its reduced spacial requirements, because the otherwise required return springs often break down or must be replaced due to spring breakage at the usually high working frequency of the compressed-air piston motor and its switch valves and the high dynamic stress related thereto. The switch times for the working piston are thereby very short because the differential slide is subjected at all times to the full switching force by the continuously supplied air pressure.

BRIEF DESCRIPTION OF THE DRAWINGS

The invention will be discussed hereinafter in connection with one exemplary embodiment and the drawings, in which.

DETAILED DESCRIPTION

Figure 1:
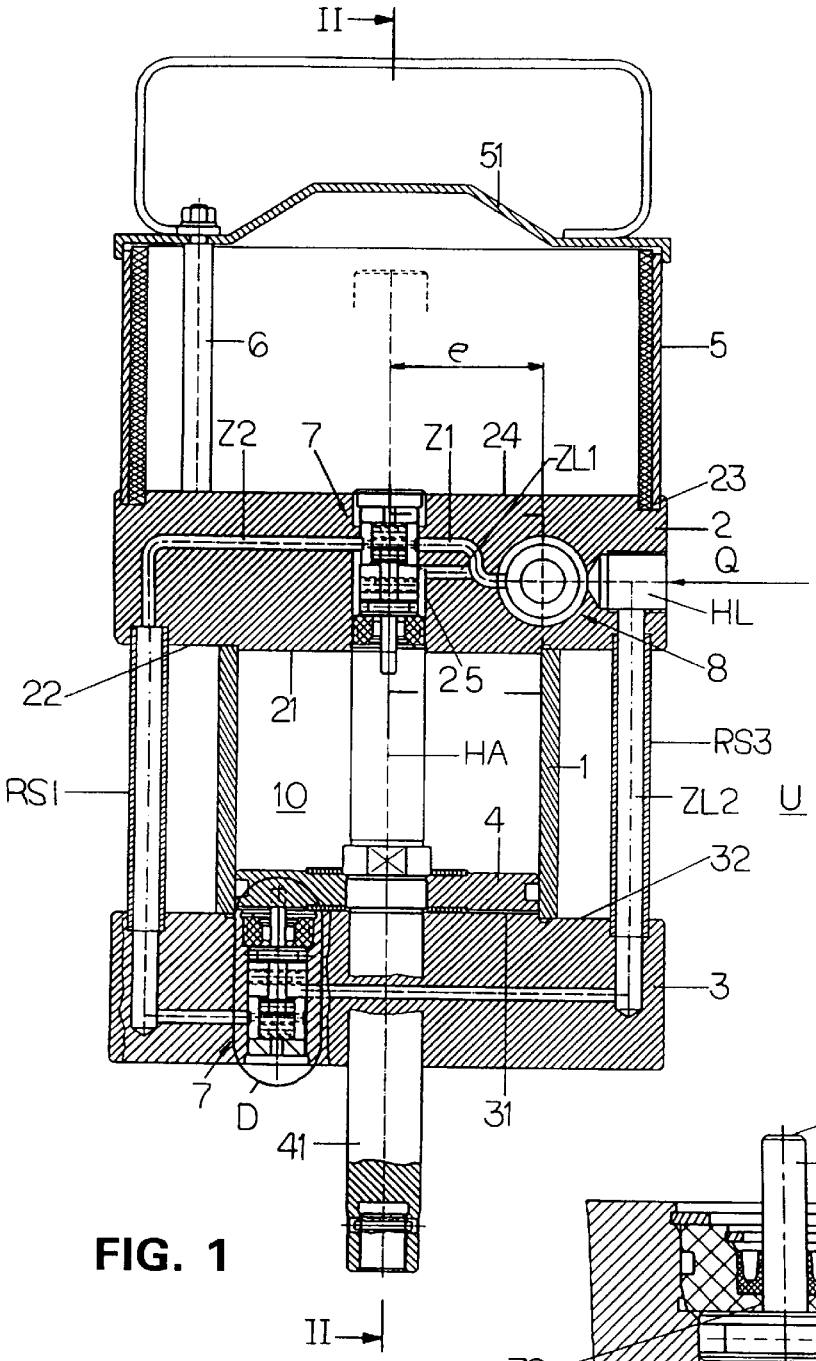
FIG. 1 illustrates a compressed-air piston engine of the invention in an essentially center longitudinal cross-sectional view in a position of use.

A compressed-air piston engine according to the invention consists in accordance with FIG. 1 essentially of a piston cylinder 1, a cylinder head 2, a cylinder bottom 3 and a working piston 4 and also the necessary control devices and compressed-air pipelines.

Figure 2:
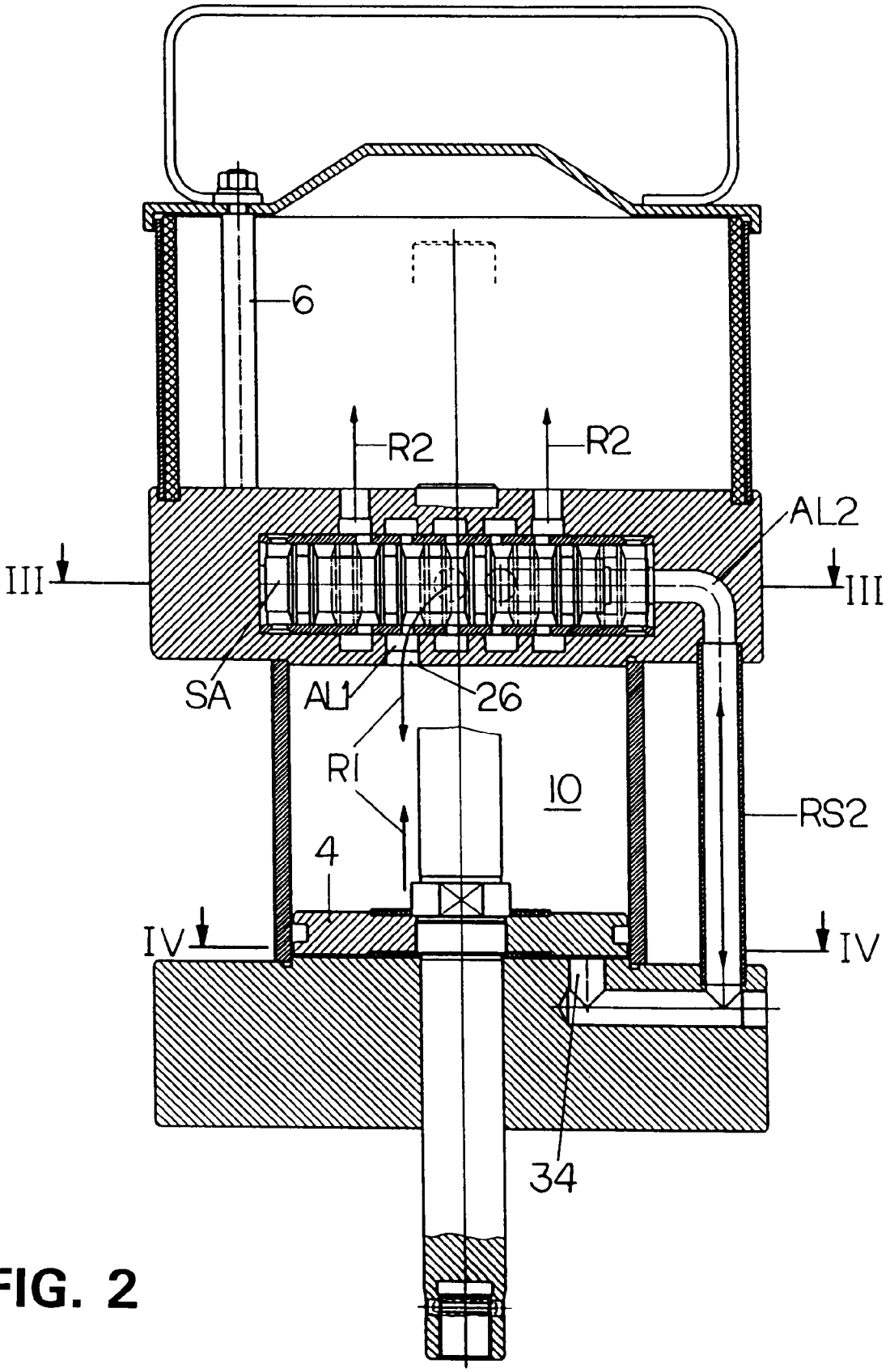
FIG. 2 is a side view of FIG. 1 corresponding to cross-section II—II of FIG. 1.
Figure 3:
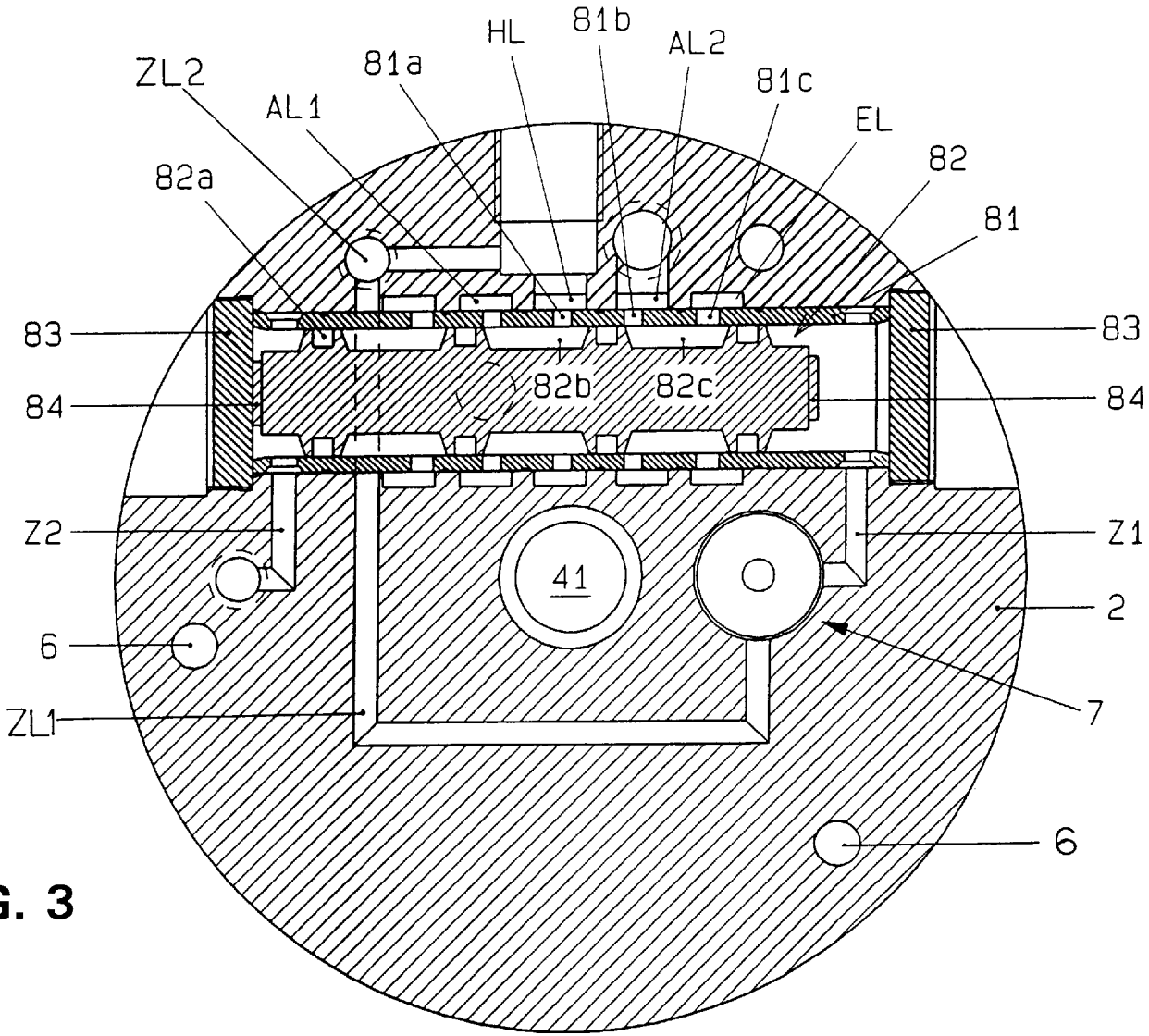
FIG. 3 is a slightly enlarged top view of FIG. 2 corresponding to cross-section III—III of FIG. 2.

The pipe-shaped piston cylinder 1 is clamped between the circular-disk-shaped cylinder head 2 and the similarly shaped cylinder bottom housing 3, and is locked centrally on these by concentric coupling plates 21, 31, which are provided on first faces 22, 32 of the cylinder head 2 and of the cylinder bottom 3, each in one piece with these, which first faces face one another. A pipe-shaped air filter 5 is fittingly inserted into an annular groove 23 on the other (second) face 24 of the cylinder head 2 and is otherwise closed off by a filter lid 51. Three clamping screws 6 clamp together the filter lid 51 with the air filter 5, the cylinder head 2, the piston cylinder 1, and the cylinder bottom 3 so that the air filter 5 and the piston cylinder 1 are thereby tightly tensioned together. FIGS. 1 and 2 each indicate one clamping screw 6, FIG. 3 shows the orientation of all three clamping screws 6.

Figure 5:
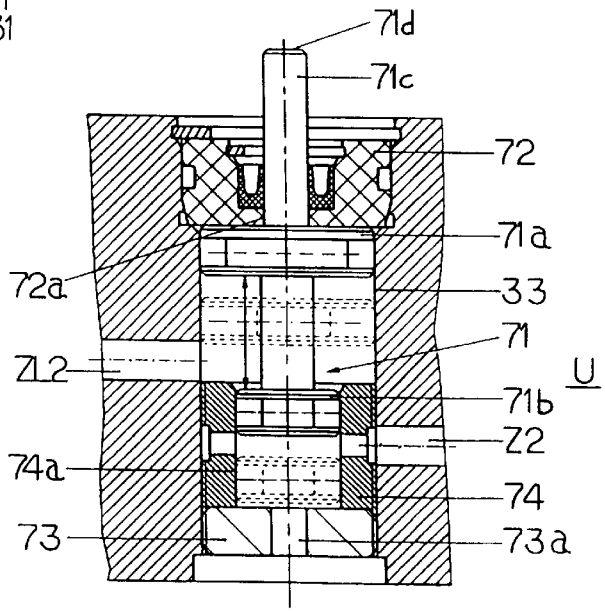
FIG. 5 shows a detail D of FIG. 1, still further enlarged, all illustrated schematically simplified.
Figure 4:
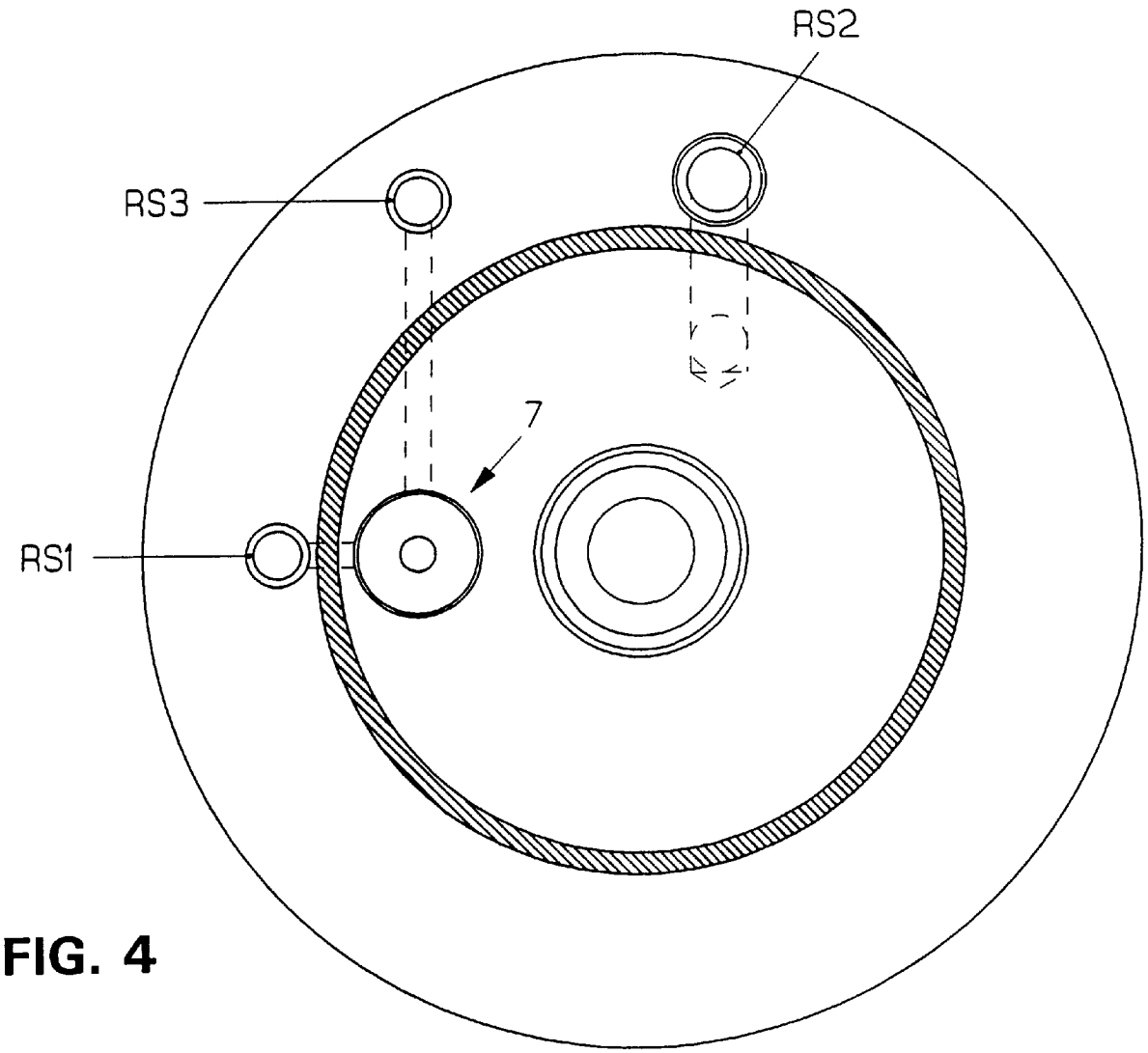
FIG. 4 is also a slightly enlarged top view of FIG. 2 corresponding to cross-section IV—IV of FIG. 2.

The longitudinal cross section in the area of the cylinder head 2 is shown in FIG. 1, deviating from the otherwise (axial) cross-sectional extent, also through a switch valve 7, which is also provided in the cylinder bottom 3 in the same manner and is shown enlarged in FIG. 5. Both switch valves 7, the position of which, spaced from the main axis HA of the compressed-air piston engine, is shown in FIGS. 3 and 4, have essentially the same design and are provided in a respective circular-cylindrical passage 25, 33 in the cylinder head 2 or in the cylinder bottom 3, which passage 25, 33 is partly smooth-walled and partly provided with a thread. The passages 25, 33 are connected on the one side through an associated branch pipeline ZL1, ZL2 to a main pipeline HL for the compressed air, which in turn is supplied with compressed air from a compressed-air source, which is not shown in the drawings and is merely indicated by a directional arrow Q; the arrangement is such that the compressed air stands at all times in the passages 25, 33. The branch pipeline ZL2 bridges outside of the piston cylinder 1 the free space between the cylinder head 2 and the cylinder bottom 3 with the help of a straight pipe section RS3, which has parallel axes with respect to the piston cylinder 1, is clamped between both.

Both switch valves 7, which work as slides, are in turn arranged axially parallel with respect to the piston cylinder 1 and have a differential slide member 71, which consists of a first valve piston 71*a* of a larger diameter and a second valve piston 71*b* of a smaller diameter, which are fixedly mounted at a distance "a" from one another on a common valve piston rod 71*c*, and the two alternately assumed end positions of which are indicated in FIGS. 1 and 5, where the first end position is shown in full line and the second in dashed lines. The passages 25, 33 are pneumatically separated from the piston chamber 10 of the piston cylinder 1 by an elastic closure 72, which is fastened in the cylinder head 2 or the cylinder bottom 3 and has a guide bore 72*a*, in which the valve piston rod 71*c* is axially movably supported. It can project into the piston chamber 10 so that its free surface 71*d* is then in the working range of the working piston 4.

The passages 25, 33 are furthermore separated from the environment U by a locking screw 73 with a central vent opening 73*a*. An aligned threaded bushing 74 with a guide cylinder 74*a* rests on the locking screw 73, in which guide cylinder 74*a* the second, smaller valve piston 71*b* is guided easily longitudinally movably. Supply/discharge pipelines Z1, Z2 end in the guide cylinder 74*a* and are connected to a slide control 8 provided in the cylinder head 2. The first, larger valve piston 71*a* is guided directly on the smooth cylinder surface of the passage 25, 33. While the supply/discharge pipeline Z1 ends directly in the slide control 8, in the case of the supply/discharge pipeline Z2 extending into and out of the cylinder bottom 3 a straight (third) pipe section RS1 bridges the free space between the cylinder head 2 and the cylinder bottom 3 and is clamped between both.

FIG. 1 indicates furthermore that the working piston 4 has a piston rod 41, which is supported centrally and slightly so as to be longitudinally movable in the cylinder head 2 and the cylinder bottom 3. A working device can be coupled to its end (here the lower); this is possible at both ends in the case of double-acting devices.

Each combined inlet/outlet port 26, 34 for the compressed air in the cylinder head 2 and the cylinder bottom 3 is provided in accordance with FIG. 2 on both sides of the working piston 4 in the piston chamber 10. The inlets/outlets 26, 34 are pneumatically connected to the slide control 8 by means of working pipelines AL1, AL2, whereby the working pipeline AL2 bridges the free space between the cylinder head 2 and the cylinder bottom 3 through a (second) straight pipe section RS2, which is clamped between both. Directional arrows R1 (FIG. 2) indicate the oscillating loading of the working piston 4.

All pipe sections RS1–3 and their spacial arrangement can be easily recognized in FIG. 4.

The slide control 8 can be best recognized in FIG. 3, in which it is illustrated centrally cross-sectioned. A control piston 82 is guided axially easily movably in a control cylinder 81 inserted in the form of a bushing into the cylinder head 2. The control cylinder 81 extends thereby transversely with respect to the main axis HA of the compressed-air piston motor and is (FIG. 1) spaced from same by the dimension "e" in such a manner that the piston rod 41 is not tangent to the axial position of the control cylinder. Two screw caps act as locking parts 83 and axially lock the control cylinder 81 in direction of its control axis SA (FIG. 2). Elastic stops 84 are respectively mounted on the end faces of the control piston 82, which stops 84 resiliently strike the adjacent locking part 83 during movement of the control piston 82.

The supply/discharge pipelines Z1, Z2 out of the switch valves 7 end near the locking part 83 so that they are not blockable and can always alternately load one associated face of the control piston 82 with compressed air. Whereas the working piston 4 and the two valve pistons 71*a*, 71*b* are each equipped with only one piston ring on their outer surfaces, a total of five areas, which are to be sealed off against one another, exist in the slide control 8; these areas are pneumatically separated from one another by four piston rings in corresponding annular grooves 82*a*, which piston rings are provided on the control piston 82 and are arranged at approximately equal axial distances from one another. Annular control chambers 82*b*, 82*c* are recessed between the sealing piston rings on the outer surface of the control piston 82, which control chambers 82*b*, 82*c* fluidly connect two adjacent control openings 81*a*, 81*b*, 81*c* with one another, into which the main pipeline HL, the working pipelines AL1, AL2 and the vent pipelines EL end; the vent pipelines EL on the other hand lead through the air filter 5 to the environment U, indicated by directional arrows R2 (FIG. 2).

The operation of the arrangement can be easily read without any difficulties from the drawings.

The differential slides 71 rest under the influence of the air pressure from the main pipeline HL, which air pressure is continuously supplied through the branch pipelines ZL1, ZL2, so long with its first valve piston 71*a* on the closure 71 as the associated valve piston rod 71*c*, which projects into the piston chamber 10, is not pressed by the working piston 4. The respective supply/discharge pipelines Z1, Z2 are in this first end position of the differential slide 71, which end position is shown in full lines, separate from the associated branch pipelines ZL1, ZL2 and vent through the vent openings 73*a*.

When the working piston 4 moves the differential slide 71 into the second end position indicated by dashed line, the compressed air then reaches into the supply/discharge pipelines Z1, Z2 so that the control piston 82 moves axially into its other end position, and the vent openings 73*a* are blocked. The supply/discharge pipelines Z1, Z2, which accordingly act as venting discharge pipelines in the first end position of the differential slide 71, end on both sides of the control piston 82 and not able to be influenced by same in the control cylinder 81 (FIG. 3).

The control piston 82 connects with its first control chamber 82*b*, as indicated in FIG. 3, the control opening 81*a* connected to the main pipeline HL to one of the control openings 81*b*, in which one of the working pipelines AL1, AL2 ends. The control chamber 82*b* is thus always guiding fluid pressure. One of the second control chambers 82*c* connects at the same time the other control opening 81*b* to one of the control openings 81*c*, into which the vent pipelines EL end, whereas the respective other second control chamber 82*c* is inactive and blocks any air flow.

The working piston 4 is in this manner moved out of its one end position, and the slide control 8 is switched as soon as the valve piston rod 71*c*, which extends freely into the piston chamber 10, is reached; the associated switch valve 7 switches then again the slide control 8.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A compressed-air piston engine, comprising a piston cylinder, a working piston mounted in the piston cylinder with a working piston rod, the working piston being moved alternately loaded, and thus oscillated in the piston cylinder by compressed air acting on its two piston surfaces by means of a slide control, the working piston rod being axially guided in at least one of a cylinder head and a cylinder bottom, in which an inlet/outlet is provided for compressed-air supply and discharge into/out of the piston cylinder, whereby the slide control includes a control piston movable in a control cylinder, and control openings are provided in the control cylinder, the control openings fluidly connecting supply/discharge pipelines for the compressed air to the control cylinder, and being influenced by the control piston, a switch valve for the compressed air in each of the cylinder head and the cylinder bottom, the switch valves being operated by the working piston for switching the slide control, the switch valves each having a valve piston rod projecting into the piston cylinder and operable by the working piston of the compressed-air piston engine, each of the switch valves having a differential slide, the differential slides each including a first valve piston having a larger piston surface and a second valve piston having a smaller piston surface, which are fastened at a fixed distance in alignment on the valve piston rod so that air pressure from a branch pipeline received in a valve housing moves the differential slide into a first end position wherein the valve piston rod projects partially into the piston cylinder.

2. The compressed-air piston engine according to claim 1, wherein the switch valve in the cylinder head is provided with its axis parallel with respect to the axis of the working piston, and a circular-cylindrical passage for supporting the differential slide is provided in both the cylinder head and the cylinder bottom.

3. The compressed-air piston engine according to claim 2, wherein the passage in the cylinder head is blocked off from the piston cylinder by means of an elastic closure, wherein the valve piston rod is capable of penetrating the elastic closure, and wherein the first valve piston is positioned against the elastic closure at one end under the action of the compressed air supplied thereto.

4. The compressed-air piston engine according to claim 3, wherein the passage in the cylinder head includes at the other end a threaded bushing set by a locking screw, and the second valve piston is guided in the threaded bushing thereby blocking off the supply/discharge pipeline leading into the switch valve in the cylinder head as long as the first valve piston rests on the closure.

5. The compressed-air piston engine according to claim 1, wherein (a) the control openings for the supply/discharge pipelines from the switch valves, a main pipeline from a compressed-air source, and vent pipelines from the compressed-air piston engine into the environment are provided to the control cylinder, (b) inlets/outlets for supplying the compressed air in the piston cylinder are connected to the slide control through working pipelines and are controlled on both sides of the working piston each by one of the switch valves, each of the switch valves is connected through one of the respective branch pipelines and the main pipeline to the compressed-air source and influences one of the supply/discharge pipelines to the control cylinder, (c) the control piston is axially oscillated by the compressed air alternately flowing through one of the supply/discharge pipelines, (d) control chambers are provided on the control piston, the control chambers influencing the control openings so that the main pipeline is alternately connected to one of the inlets/outlets, and at the same time one of the outlets is connected to the environment, and (e) the branch pipelines extending from the main pipeline are branched off unable to be blocked.

6. The compressed-air piston engine according to claim 5, wherein the control chambers are designed such that the compressed-air source is fluidly connected through the main pipeline at all times to one of the inlets/outlets.

7. The compressed-air piston engine according to claim 5, wherein one of the branch pipelines is guided through a first pipe section, which is clamped between the cylinder head and the cylinder bottom outside of the piston cylinder.

8. The compressed-air piston engine according to claim 7, wherein one of the working pipelines for the inlets/outlets is guided through a second pipe section, which is clamped between the cylinder head and the cylinder bottom outside of the piston cylinder.

9. The compressed-air piston engine according to claim 8, wherein the supply/discharge pipeline of one of the switch valves is connected to the slide control through a third pipe section, which is clamped between the cylinder head and the cylinder bottom outside of the piston cylinder.

10. The compressed-air piston engine according to claim 5, wherein a second control chamber is provided on both sides of the first control chamber on the control piston, and is fluidly connected alternately to the associated outlet.

11. The compressed-air piston engine according to claim 1, wherein the control cylinder is closed on its end faces by locking parts.

12. The compressed-air piston engine according to claim 11, wherein elastic stops are provided on the end faces of the control piston, said stops being capable of contacting the locking parts.

13. The compressed-air piston engine according to claim 11, wherein the supply/discharge pipelines from the switch valves end in the vicinity of the locking parts so that the supply/discharge pipelines cannot be controlled by the control piston.

14. The compressed-air piston engine according to claim 1, wherein the slide control is provided in the cylinder bottom and the axes of the control piston and of the working piston are approximately vertically aligned with respect to each other.

15. The compressed-air piston engine according to claim 14, wherein the axis of the control piston is spaced from the axis of the working piston.

16. The compressed-air piston engine according to claim 1, wherein the slide control is provided in the cylinder head and the axes of the control piston and of the working piston are approximately vertically aligned with respect to each other.

17. The compressed-air piston engine according to claim 1, wherein the slide control is provided on the cylinder bottom and the axes of the control piston and of the working piston are approximately vertically aligned with respect to each other.

18. The compressed-air piston engine according to claim 1, wherein the slide control is provided on the cylinder head and the axes of the control piston and of the working piston are approximately vertically aligned with respect to each other.

* * * * *